US005980126A

United States Patent [19]

Yamamoto et al.

[11] Patent Number: 5,980,126

[45] Date of Patent: Nov. 9, 1999

[54] AUTOMATIC DEVELOPING APPARATUS AND METHOD

[75] Inventors: Kenro Yamamoto; Seiichi Yoshizawa; Ryoei Nozawa; Akira Sugiyama, all of Kanagawa, Japan

[73] Assignee: Fuji Photo Film Co., Ltd., Kanagawa, Japan

[21] Appl. No.: 08/829,896

[22] Filed: Mar. 25, 1997

[30] Foreign Application Priority Data

Mar. 27, 1996 [JP] Japan ..... 8-072983

[51] Int. Cl.[6] ..... G03D 13/00

[52] U.S. Cl. ..... 396/571; 396/578

[58] Field of Search ..... 396/570, 571, 396/578, 632, 572; 219/216; 399/81

[56] References Cited

U.S. PATENT DOCUMENTS 4,373,802 2/1983 Yuge et al. ..... 399/81
4,421,399 12/1983 Steube ..... 396/571
4,914,476 4/1990 Nishitsuji et al. ..... 219/216
4,994,837 2/1991 Samuels et al. ..... 396/571
5,262,816 11/1993 Samuels et al. ..... 396/571

*Primary Examiner*—D. Rutledge
*Attorney, Agent, or Firm*—Sughrue, Mion, Zinn, Macpeak & Seas, PLLC

[57] ABSTRACT

In an automatic film developer, measurements are taken of internal temperature parameters during a warm up phase. Based on measured temperature values a time for completing the warm up phase is calculated. The calculated time for warm up is displayed so that it can be read by an operator. When the calculated time for warm up completion has elapsed, an indication is displayed that the film developer is operational. During the warm up phase, film is not allowed to advance through the automatic film developer. When the calculated time for warm up completion has elapsed, advance of film through the film developer is automatically started.

20 Claims, 6 Drawing Sheets

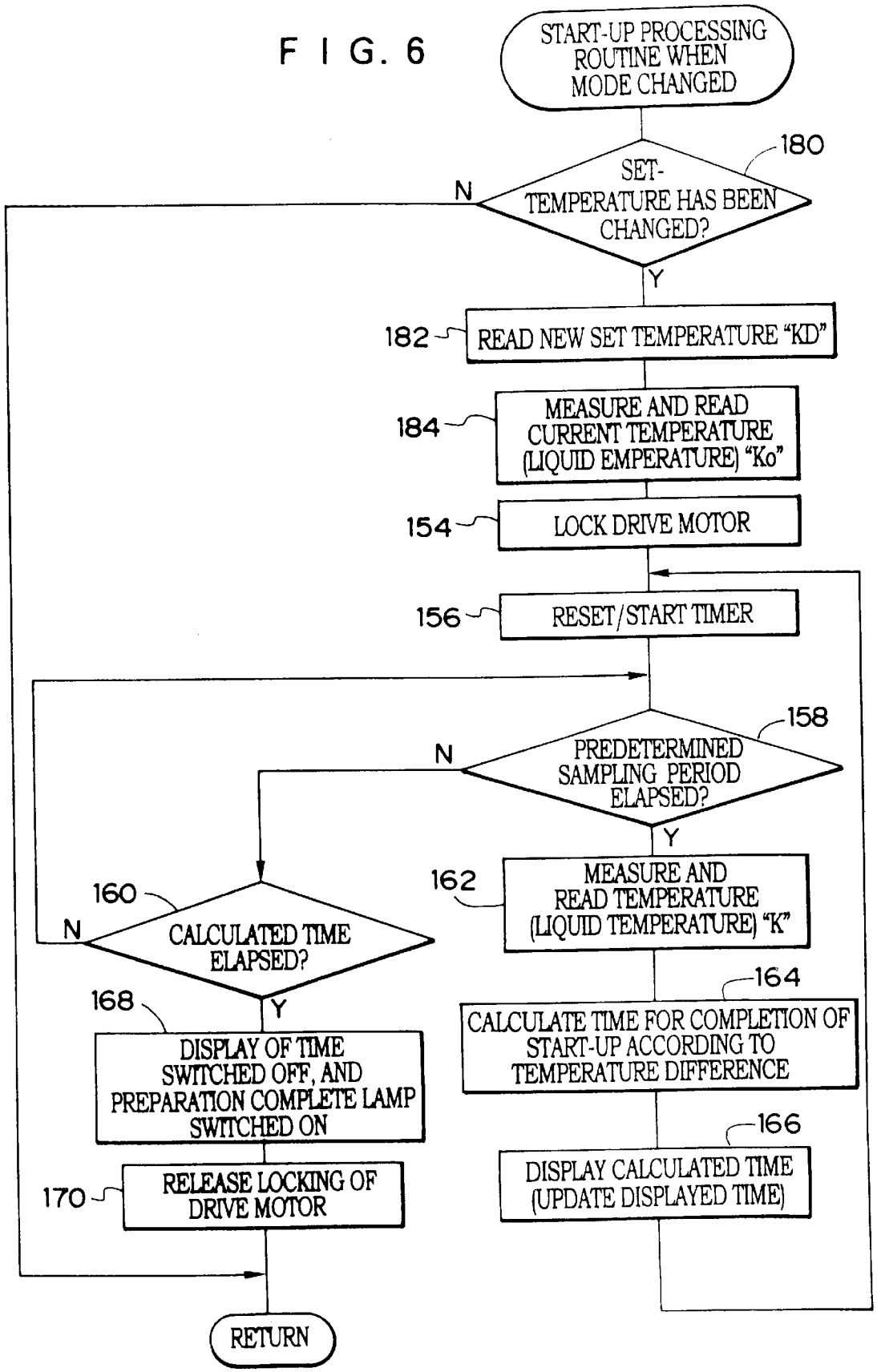
F I G. 6
START-UP PROCESSING ROUTINE WHEN MODE CHANGED
180
SET-TEMPERATURE HAS BEEN CHANGED?
N
Y
182
READ NEW SET TEMPERATURE "KD"
184
MEASURE AND READ CURRENT TEMPERATURE (LIQUID EMPERATURE) "Ko"
154
LOCK DRIVE MOTOR
156
RESET/START TIMER
158
PREDETERMINED SAMPLING PERIOD ELAPSED?
N
Y
162
MEASURE AND READ TEMPERATURE (LIQUID TEMPERATURE) "K"
164
CALCULATE TIME FOR COMPLETION OF START-UP ACCORDING TO TEMPERATURE DIFFERENCE
166
DISPLAY CALCULATED TIME (UPDATE DISPLAYED TIME)
160
CALCULATED TIME ELAPSED?
N
Y
168
DISPLAY OF TIME SWITCHED OFF, AND PREPARATION COMPLETE LAMP SWITCHED ON
170
RELEASE LOCKING OF DRIVE MOTOR
RETURN

AUTOMATIC DEVELOPING APPARATUS AND METHOD

BACKGROUND OF THE INVENTION

1. Field of the Invention

The present invention relates to an automatic developing apparatus and a method in which a photosensitive material can be appropriately processed when a processing solution or a drying section is maintained at a predetermined set temperature.

2. Description of the Related Art

In an automatic developing apparatus in which a photosensitive material on which an image is exposed is processed in such a manner as to be immersed in processing solutions such as a developing solution, a fixing solution, and washing water, a drying section and these processing solutions are maintained within respective predetermined temperature ranges by heating means or cooling means so that the photosensitive material can be efficiently processed at the optimum quality. It is to be noted that hereinafter "processing solution" may be used to refer to any of these solutions.

In the automatic developing apparatus like the above, when an operating switch of the apparatus is turned on, a heater for heating the processing solution is actuated so that the temperature of the processing solution is set at a predetermined temperature (start-up processing). When the start-up processing is completed, the photosensitive material can be processed at the optimum quality. Further, the automatic developing apparatus is provided with the drying section for drying the photosensitive material after having been subjected to the processing by the processing solutions. In this drying section as well, the temperature of dry air is controlled so that the photosensitive material is brought into an appropriate dried state having no insufficient or over-dried state, and during the start-up processing an interior of the drying section is heated so that the photosensitive material can be appropriately dried by components within the drying section.

On the other hand, when the start-up processing begins with the operating switch of the automatic developing apparatus being turned on, the processing solution and the components within the drying section are in a cooled state in accordance with an environmental temperature at which the automatic developing apparatus is installed, and therefore, a lot of time is required for heating the processing solution and the components within the drying section up to the temperature which allows the photosensitive material to be appropriately processed. Further, in the automatic developing apparatus, when the temperature of the processing solution is detected and it is confirmed that the start-up processing has been completed, an indication is usually given, which informs that the apparatus has been brought into a state of allowing processing of the photosensitive material. In fact, an apparatus which cannot start processing of the photosensitive material until this indication is given is disclosed in U.S. Pat. No. 4,994,837.

Accordingly, for example, even in a case in which start-up of the automatic developing apparatus is effected for the reason that there arises a need of urgently processing the photosensitive material, since a timing at which start-up of the automatic developing apparatus is completed and processing of the photosensitive material can be started is not clearly determined, an operator should be constantly in the vicinity of the automatic developing apparatus until the start-up processing is completed and other operations may be affected thereby. As a result, operating efficiency may deteriorate. Further, when the photosensitive material is mistakenly inserted in the automatic developing apparatus before the start-up processing is completed, a finished quality of the photosensitive material may be dissatisfactory.

SUMMARY OF THE INVENTION

In view of the above-described circumstances, it is an object of the present invention to provide an automatic developing apparatus and a method in which, for example, a start-up time which allows processing of the photosensitive material after an operating switch is turned on can be easily predicted and no damage is caused in a finished quality of the photosensitive material.

A first aspect of the present invention resides in that an automatic developing apparatus which is used to process a photosensitive material and which includes a developing tank, a fixing tank, and a washing tank, comprises: temperature detecting means which detects a temperature of a processing solution in any one of the three tanks; temperature setting means which sets the temperature of the processing solution at a target temperature; temperature adjusting means which adjusts the temperature of the processing solution; temperature controlling means which controls the temperature adjusting means so that the temperature of the processing solution is adjusted from a temperature detected by the temperature detecting means to a set temperature; and time calculating means for calculating a time for the temperature adjusting means to adjust the temperature of the processing solution from the detected temperature to the set temperature.

In accordance with this aspect of the present invention when the temperature of the processing solution in any one of the processing tanks is set by the temperature setting means, the temperature of the processing solution is detected by the temperature detecting means, and the temperature adjusting means starts adjustment of the temperature of the processing solution so that the temperature of the processing solution becomes the set temperature. At this time, the time calculating means calculates, on the basis of the set temperature and the detected temperature, the time required for the temperature of the processing solution to reach the set temperature.

As a result, it is possible to recognize a time of completion of the start-up, i.e., a timing at which the temperature of the processing solution reaches the set temperature, and it is not necessary to continue to measure the temperature of the processing solution until it reaches the set temperature.

Another aspect of the present invention resides in that an automatic developing apparatus further comprises: introducing means which introduces the photosensitive material into the automatic developing apparatus; and drive controlling means which controls operation of the introducing means, which drive controlling means including introduction-of-photosensitive material prohibiting means which prohibits operation of the introducing means from a timing at which the temperature of the processing solution is detected by the temperature detecting means until a timing at which the time calculated by the time calculating means has elapsed.

In accordance with this aspect of the present invention, operation of the introducing means is controlled on the basis of the calculation results of the time calculating means. As a result, the photosensitive material is not introduced into the automatic developing apparatus until the start-up of the processing solution is completed, and therefore, there is no possibility that the photosensitive material is immersed in the processing solution prior to completion of the start-up.

Another aspect of the present invention resides in that an automatic developing apparatus according to the first aspect further comprises display means which indicates the time calculated by the time calculating means.

In accordance with this aspect of the present invention, since the calculation results of the time calculating means is displayed on the display means, it is possible to clearly determine a timing for completion of the start-up processing from displayed contents of the display means.

As described above, by providing, on the display means, display in which completion of the start-up of the processing solution and a timing for completing the start-up are made clear, it is possible for an operator to effect other operations on the basis of the displayed contents, thereby resulting in an improvement of the operating efficiency.

Another aspect of the present invention resides in that an automatic developing apparatus further comprises: completion-of-processing-preparation displaying means which indicates that processing preparation of the automatic developing apparatus is completed after the time calculated by the time calculating means starting from the time of detection of the temperature by the temperature detecting means elapsed.

In accordance with this aspect of the present invention, the time of completion of the start-up is decided on the basis of the calculation results of the time calculating means and the completion of the start-up processing is displayed on the display means at a timing at which the start-up is completed.

Further aspect of the present invention is such that an automatic developing apparatus which is used to process a photosensitive material and which is formed from a developing tank, a fixing tank, a washing tank, and a drying section for drying the photosensitive material conveyed from the washing tank, comprises: temperature detecting means which detects a temperature of a portion of the drying section; temperature setting means for setting the temperature of the portion of the drying section at a target temperature; temperature adjusting means for adjusting the temperature of the portion of the drying section; temperature controlling means for controlling the temperature adjusting means so that the temperature of the portion of the drying section is adjusted from a temperature detected by the temperature detecting means to the set temperature; and time calculating means for calculating a time for the temperature adjusting means to adjust the portion of the drying section from the detected temperature to the set temperature.

In accordance with this further aspect of the present invention, the temperature of a previously-designated predetermined position within the drying section, for example, the temperature of a component or air within the drying section is detected by the temperature detecting means and the start-up processing is effected so that the temperature at the predetermined position within the drying section becomes the set temperature. At this time, the time calculating means calculates the timing at which the temperature at the predetermined position reaches the set temperature. It is possible to recognize, from the calculated results, the time of completion of the start-up of the drying section.

Meanwhile, the position within the drying section at which detection of temperature is effected by the temperature detecting means is preferably a portion at which a finished state of the photosensitive material is affected by the temperature thereof.

Still further aspect of the present invention is such that, in an automatic developing apparatus, the temperature detecting means is means for detecting a temperature of dry air and the temperature adjusting means is a heating roller that heats up the dry air.

In accordance with this still further aspect of the present invention, the timing at which the temperature of dry air reaches the set temperature is calculated by the time calculating means and the time for the temperature of dry air to reach the set temperature is thereby set clear.

As described above, the present invention is constructed in that the temperature of the processing solution and the temperature of an interior of the drying device or dry air, which are set so as to finish the photosensitive material at an appropriate quality, are detected by the temperature detecting means, and on the basis of the detection results and the set temperatures, the timing at which the temperatures of the processing solution, and the interior of the drying device or dry air reach the target temperatures is calculated. For this reason, the time of the completion of the start-up becomes clear from the calculation results, and for example, even when it is necessary for the photosensitive material to be urgently processed, it is not necessary for the operator to wait in the vicinity of the apparatus until the start-up processing is completed, thereby improving the operating efficiency.

BRIEF DESCRIPTION OF THE DRAWINGS

FIG. 6 is a flow chart which shows an example of start-up processing at the time of changing a processing mode of an automatic developing apparatus according to a second embodiment of the present invention.

DESCRIPTION OF THE PREFERRED EMBODIMENTS

[First Embodiment]

Figure 1:
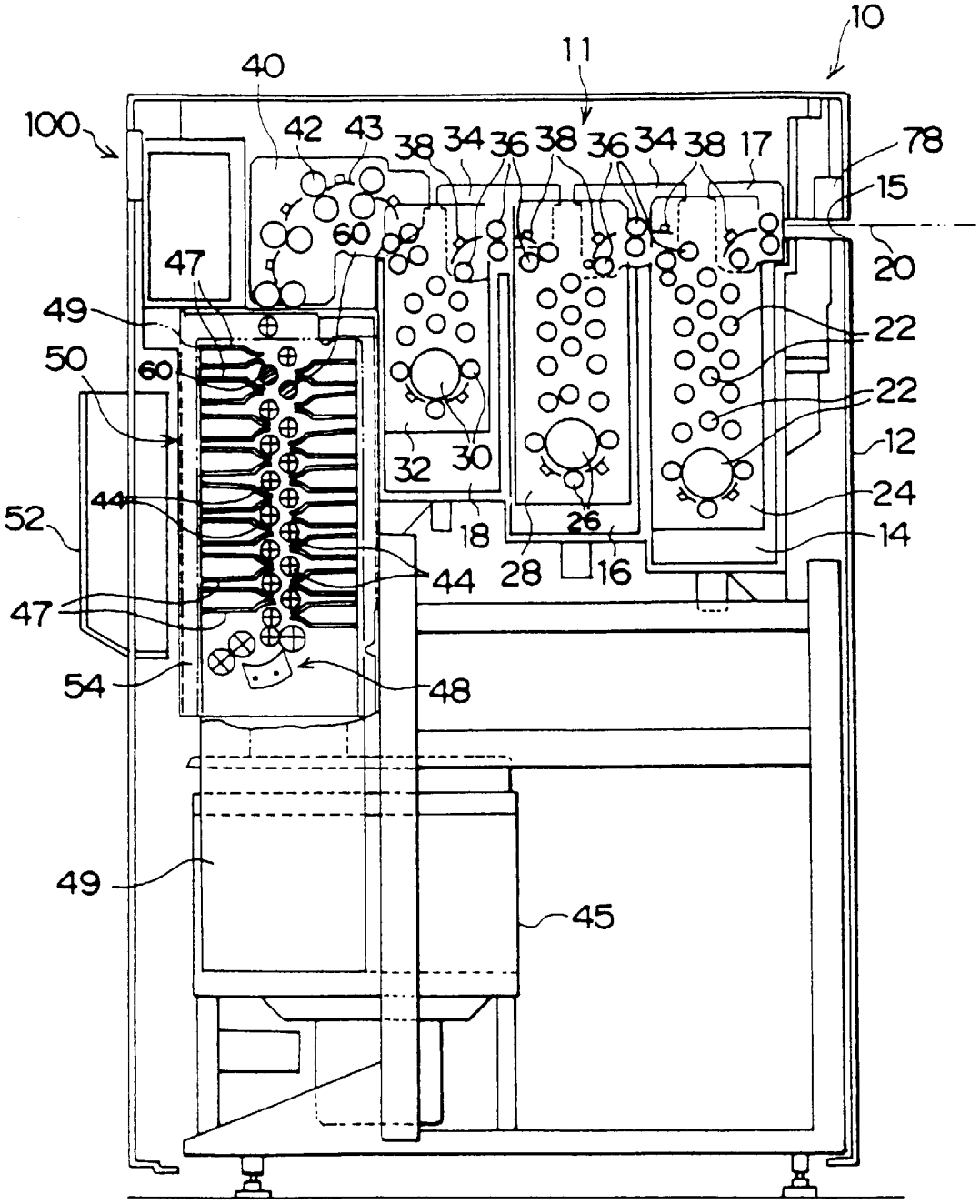
FIG. 1 is a schematic structural view of an automatic developing apparatus according to an embodiment of the present invention.

FIG. 1 shows an example of an automatic developing apparatus to which the present invention is applied. In the automatic developing apparatus 10, a photographic film which is an example of a photosensitive material (for example, X-ray film; which will be hereinafter referred to as "film 20") is processed in such a manner as to be immersed in a developing solution, a fixing solution, and washing water, successively, and thereafter, the film is subjected to drying processing.

The automatic developing apparatus 10 includes a processing-solution processing section 11 (hereinafter referred to as a "processing section 11") and a drying section 50 within a machine casing 12. The processing section 11 includes a developing tank 14 in which a developing solution is contained, a fixing tank 16 in which a fixing solution is contained, and a washing tank 18 in which washing water is contained. The developing tank 14, fixing tank 16, and washing tank 18 are respectively provided with conveying racks 24, 28 and 32 each having conveying rollers 22, 26 and 30, wherein these conveying racks are disposed in such a manner as to be immersed in the developing solution, fixing solution, and washing water, respectively.

Further, the processing section 11 is constructed such that an insertion rack 17 is provided in the vicinity of an insertion opening 15 provided in the machine casing 12, and cross-over racks 34 each having conveying rollers 36 and guides 38 are provided bridging over the developing tank 14 and the fixing tank 16 and also bridging over the fixing tank 16 and the washing tank 18.

The film 20 inserted from the insertion opening 15 is pulled into the machine casing 12 by the insertion rack 17 and is conveyed by rotational driving of the conveying rollers 22, 26, 30, and 36, and is further subjected to development, fixing and washing processing in such a manner as to be immersed in the developing solution, the fixing solution, and the washing water.

A squeeze rack 40 having squeeze rollers 42 and guides 43 is provided above the space between the washing tank 18 and the drying section 50. The film 20 conveyed out from the washing tank 18 is squeezed by the squeeze rollers 42 while being guided by the guides 43, and thereafter, is further conveyed to the drying section 50.

In the drying section 50, a plurality of conveying rollers 44 including heating rollers 60 are provided in a zigzag manner between rack side plates of a drying rack 54 and a conveying path in which the film 20 is guided and conveyed in a downward direction is formed between these rollers. Provided within the drying section 50 are a plurality of blowout pipes 47 each including a blowout opening directed from a position between the adjacent conveying rollers 44 to the surface of the film 20. Supplied into each of the plurality of blowout pipes 47 by way of a chamber 49 is dry air generated by unillustrated heater and drying fan in a dry air generating section 45.

As a result, in the drying section 50, the film 20 conveyed therein by the squeeze rack 40 is heated to be dried by the heating rollers 60 and dry air blown out from the blowout pipes 47 while being conveyed by the conveying rollers 44 including the heating rollers 60.

A dry turning section 48 is provided in a lower portion of the drying section 50 and the film 20 that has gone through the drying processing is guided and conveyed in an obliquely upward direction and is discharged into a receiving box 52 provided on an external surface of the machine casing 12.

Figure 2:
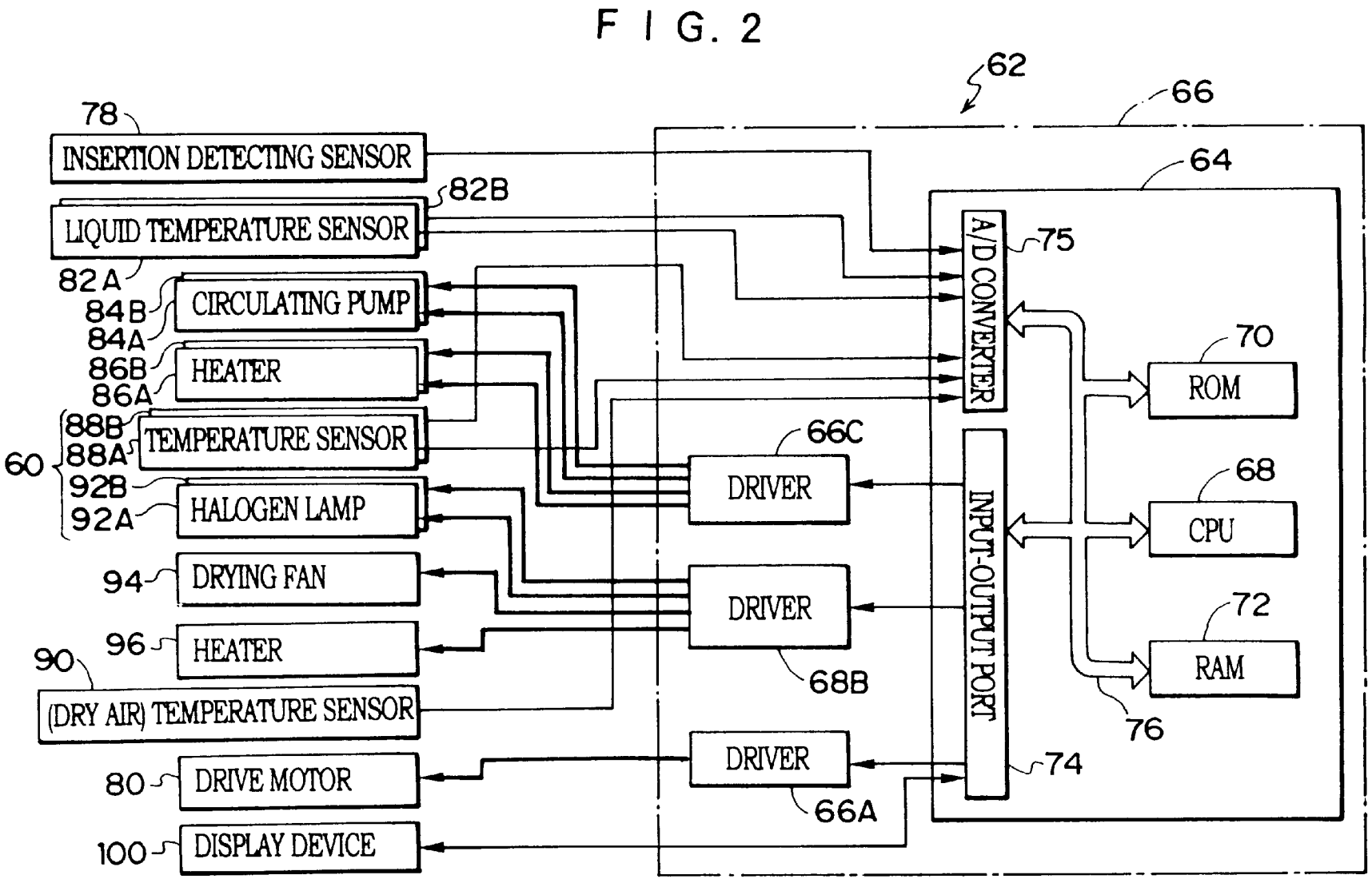
FIG. 2 is a schematic block diagram which shows a portion of a control section of the automatic developing apparatus.

FIG. 2 shows a portion of a control section 62 of the automatic developing apparatus 10. The control section 62 of the automatic developing apparatus 10 is provided with a controller 66 including a microcomputer (which will be hereinafter referred to as "microcomputer 64"). The microcomputer 64 has a general structure in which CPU 68, ROM 70, RAM 72, input/output port 74, AD converter 75, and the like are connected by a bus 76 formed by a data bus and a control bus.

A drive motor 80 is connected via a driver 66A to the input/output port 74 of the microcomputer 64 provided in the controller 66 and is provided to rotate the conveying rollers which form the conveying path of the film 20 within the automatic developing apparatus 10. Further, an insertion detecting sensor 78 is connected to the analog-to-digital converter (hereinafter referred to as "A/D converter") 75.

As shown in FIG. 1, the insertion detecting sensor 78 is provided in the vicinity of the insertion opening 15 and detects passing of the film 20 inserted from the insertion opening 15.

When it is detected by the insertion detecting sensor 78 that the leading end of the film 20 has been inserted, the microcomputer 64 drives the drive motor 80 and starts conveying the film 20. Further, when insertion of a following film 20 is not detected within a predetermined time after it is detected by the insertion detecting sensor 78 that the trailing end of the film 20 has passed through the insertion opening 15, the microcomputer 64 stops driving of the drive motor 80 so as to bring the automatic developing apparatus 10 into a waiting state (i.e., a standby state).

As shown in FIG. 2, a liquid temperature sensor 82A which detects the temperature of the developing solution and a liquid temperature sensor 82B which detects the temperature of the fixing solution are connected to the A/D converter 75 of the microcomputer 64. Further, a circulation pump 84A which allows circulation of the developing solution in the developing tank 14, a circulation pump 84B which allows circulation of the fixing solution in the fixing tank, a heater 86A for heating the developing solution, and a heater 86B for heating the fixing solution are all connected via the driver 66C to the input/output port 74.

The microcomputer 64 actuates the circulation pumps 84A, 84B so as to circulate and agitate the developing solution within the developing tank 14 and the fixing solution within the fixing tank 16. Then, the heaters 86A, 86B are actuated on the basis of respective detected results of the liquid temperature sensors 82A, 82B, and the developing solution and the fixing solution are thereby maintained at respective predetermined temperatures.

Meanwhile, the automatic developing apparatus 10 is provided with unillustrated replenishing means for supplying replenishes for the developing tank 14, the fixing tank 16, and the washing tank 18, and therefore, the developing solution, the fixing solution, and the washing water are respectively replenished so that the film 20 can be processed at the most suitable state.

The temperature sensors 88A, 88B which detect the temperatures of the heating rollers 60 and the temperature sensor 90 which detects the temperature of dry air are connected to the A/D converter 75 of the microcomputer 64. Further, halogen lamps 92A, 92B for heating the heating rollers 60, a drying fan 94 and a heater 96 which are both provided in the dry air generating section 45 are connected via the driver 66B to the input/output port 74.

The microcomputer 64 effects an on-off operation of the halogen lamps 92A, 92B in accordance with the detected results of the temperature sensors 88A, 88B to heat the heating rollers 60 to a predetermined temperature, and also controls the temperature of dry air generated by the drying fan 94 and the heater 96 on the basis of the detected result of the temperature sensor 90 and the like, so as to effect drying processing of the film 20.

As shown in FIG. 1, the automatic developing apparatus 10 is provided with a display device 100 on an external surface of the machine casing 12 above the receiving box 52. The display device 100 displays various indications in accordance with an operating state of the automatic developing apparatus 10 and the like, and allows various operations of the automatic developing apparatus 10. As shown in FIG. 2, the display device 100 is connected to the microcomputer 64 via the input/output port 74 of the controller 66.

Figure 3:
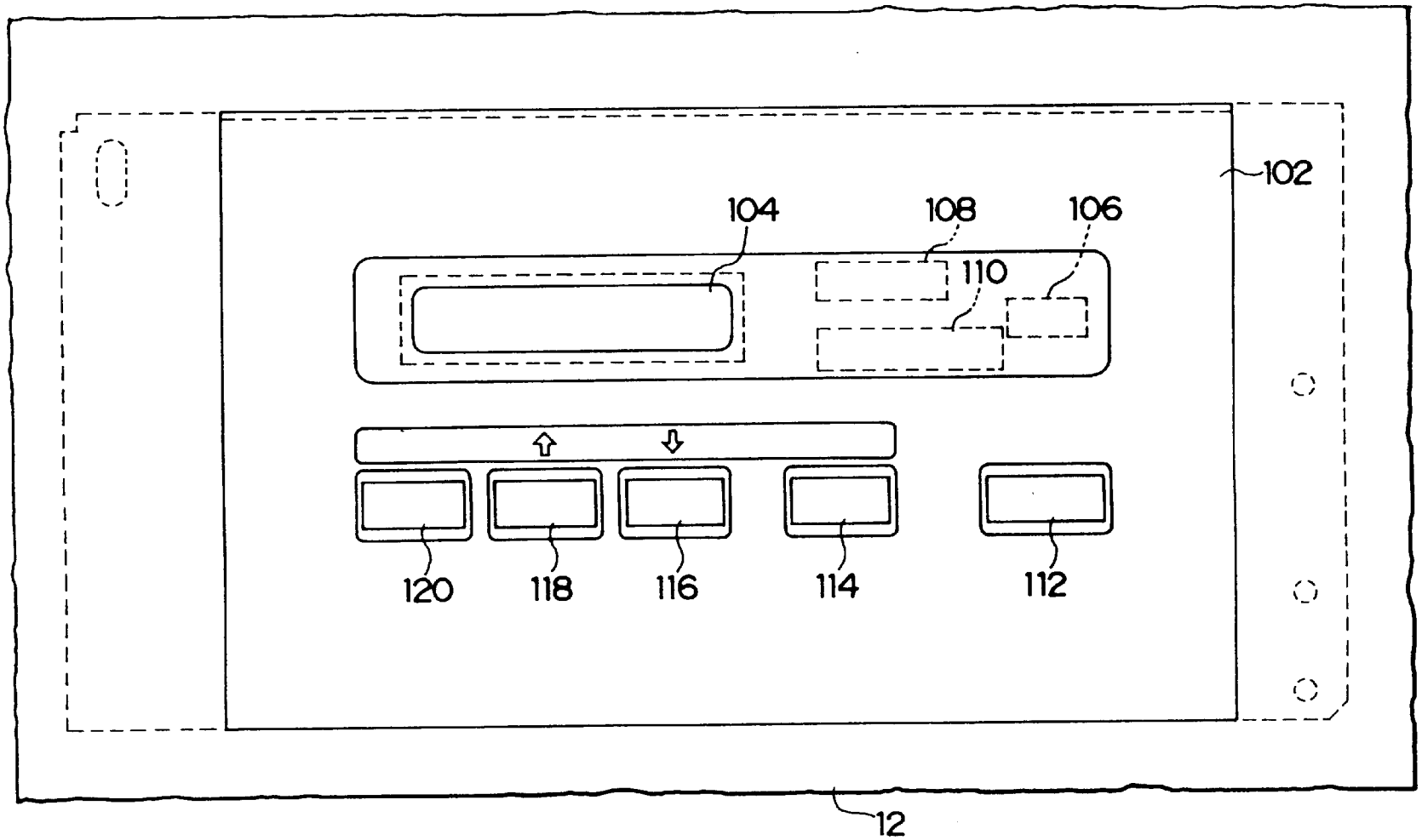
FIG. 3 is a front view showing an example of a display panel of a display device.

As shown in FIG. 3, a plurality of operating switches and display means are provided on the surface of the panel 102 of the display device 100. The display means provided in the panel 102 includes a liquid crystal display (which will be hereinafter referred to as "LCD 104") using liquid crystal display elements. The LCD 104 allows display of various characters (for example, one character is shown by 5×7 dots, and every 16 characters is displayed in each of two lines), and on the basis of signals from the controller 66, allows display of an operational state of the automatic developing apparatus 10 and operation items or the like for setting various operations.

Further, the display means of the panel 102 also includes an operating lamp 106 which is turned on when the automatic developing apparatus 10 is in an operating state (i.e., the power source is in an on-state), a preparation complete lamp 108 which is turned on when the film 20 can be processed by the automatic developing apparatus 10, and a cartridge lamp 110 for giving warning of residual quantity in an unillustrated cartridge containing a replenisher (replenished undiluted solution) to be supplied to the developing tank 14 and the fixing tank 16. When the operating lamp 106 and the preparation complete lamp 108 are both turned on, the automatic developing apparatus 10 is in a standby state in which the film 20 can be processed. Lighting of the cartridge lamp 110 indicates that the liquid level in the cartridge which contains the replenisher to be supplied to the developing tank 14 and the fixing tank 16 has been brought into a low state.

The operating switches provided on the panel 102 of the display device 100 comprise sheet switches such as an operating switch 112, a buzzer switch 114, a light switch 116, a replenishment switch 118, and a mode switch 120. The automatic developing apparatus 10 is turned on and off (operated or stopped) by operating the operating switch 112, and the above-described operating lamp 106 is correspondingly turned on and off. Further, the light switch 116 allows lighting of an unillustrated lamp which illuminates the panel 102 so that an operator can confirm the indicated contents of the display device 100 in a darkroom. The replenishment switch 118 is operated when, for example, a replenisher remained in the cartridge is forcibly supplied to each processing tank prior to exchange of cartridges. The mode switch 120 is operated when various settings for operating the automatic developing apparatus 10 and the operating condition (i.e., operation mode) of the apparatus are altered, and when the mode switch 120 is operated, respective operational contents of the buzzer switch 114, the light switch 116 and the replenishment switch 118 are altered. Meanwhile, the display means and the operating switches are in this embodiment shown as way of example, and the present invention is not limited to the aforementioned.

On the other hand, when the automatic developing apparatus 10 in a stopped state starts operating by switching (on) the operating switch 112, first, the apparatus starts heating each processing solution in the processing section 11 and the interior of the drying section 50 and effects a so-called "start-up processing" in which the temperatures of the processing solutions and the drying section 50 are raised to respective predetermined temperatures which allow processing of the film 20 in the optimum state.

At this time, the microcomputer 64 of the controller 66 detects respective temperatures of the developing solution within the development tank 14, the fixing solution within the fixing tank 16, and the interior of the drying section 50 at the beginning point of start-up processing, and calculates the time from beginning to end of the start-up processing from respective set temperatures and each capacity of the heaters 86A, 86B, the halogen lamps 92A, 92B, and the heater 96 which are heating means for heating the developing solution, fixing solution, and the interior of the drying section 50. The thus calculated time required for completing the start-up processing is displayed on the display device 100 and can be thereby observed from an external side of the automatic developing apparatus 10. As a result, when the operating switch 112 is turned on, on the panel 102 of the display device 100 the operating lamp 106 is lighted on and the time required for completing the start-up processing is displayed on the LCD 104. The required time for completion of the start-up processing, which is to be displayed on the LCD 104, is updated with the lapse of time and is gradually reduced, and a remaining time is constantly indicated in real time.

Further, when the start-up processing begins with the operating switch 112 being turned on, the controller 66 locks operation of the drive motor 80 in a standby state which is provided to operate in accordance with the detected results of the insertion detecting sensor 78. Namely, the controller 66 prohibits operation of the drive motor 80 effected in accordance with the detected results of the insertion detecting sensor 78 until the start-up processing is completed, so that the film 20 is not provided to be processed before the completion of the start-up processing.

The controller 66 is not provided to recognize the completion of the start-up processing of the automatic developing apparatus 10 by actually measuring respective temperatures of the developing solution, the fixing solution, and the interior of the drying section 50. In fact, the controller 66 is provided to predict and display the time required for completing the start-up processing prior to the completion of the start-up processing on the LCD 104 of the display device 100, switch off the displayed time on completion of the start-up processing, switch on the preparation complete lamp 108, and effect thereby a so-called lock releasing processing which allows operation of the drive motor 80 effected in accordance with the detected results of the insertion detecting sensor 78. As a result, when the film 20 is inserted from the insertion opening 15, the drive motor 80 operates and the film 20 can be processed in the automatic developing apparatus 10 accordingly.

Next, an operation of the present embodiment will be described.

In the automatic developing apparatus 10 in a standby state (i.e., in the state in which the operating lamp 106 and the preparation complete lamp 108 are both switched on), when the film 20 is inserted from the insertion opening 15, the apparatus starts processing the film 20. Namely, in the automatic developing apparatus 10, when the leading end of the film 20 inserted from the insertion opening 15 is detected by the insertion detecting sensor 78 provided in the vicinity of the insertion opening 15, the drive motor 80 operates to start conveying the film 20. After the film 20 has been thus inserted in the automatic developing apparatus 10, the film 20 is successively immersed in the developing solution, the fixing solution, and the washing water for development processing, fixing processing, and washing processing. At this time, the developing solution and the fixing solution are maintained in such a manner as to be heated at respective predetermined temperatures, and therefore, the film 20 can be processed at an appropriate quality.

The film 20 that has gone through the washing processing is sent into the drying section 50 while being conveyed and squeezed by the squeeze rack 40. The film 20 sent into the drying section 50 is heated to be dried by heat of the heating rollers 60 heated at the predetermined temperature and by dry air blown out from the blowout pipes 47 while being conveyed by the drying rack 54, and thereafter, is discharged in the receiving box 52. It is to be noted that each of the heating rollers is a kind of roller which guides a film to be dried along a predetermined conveying path and is formed as a hollow roller made of such thermal conductive materials as stainless steel, aluminum or the like, in which a halogen lamp 92(A,B) serving as a heating element is disposed in the rotational center of a hollow portion of the roller. By controlling energization to the halogen lamp, the surface temperature of the heating roller can be adjusted.

When the automatic developing apparatus 10 is in a stopped state with the operating switch 112 being turned off, not only operation of the processing section 11, but operation of the drying section 50 is also stopped, and therefore, each processing solution and the interior of the drying section 50 are in a cooled state in accordance with the temperature outside the apparatus. In this state, when the operation of the automatic developing apparatus 10 is started by switching on the operating switch 106, the start-up processing for heating up the processing solutions (i.e., the developing solution and the fixing solution) and the drying section 50 (the heating rollers 60, the conveying rollers 44, and the like) to the respective predetermined temperatures is effected prior to the processing of the film 20 so that the film 20 can be processed in the most suitable state.

Figure 4:
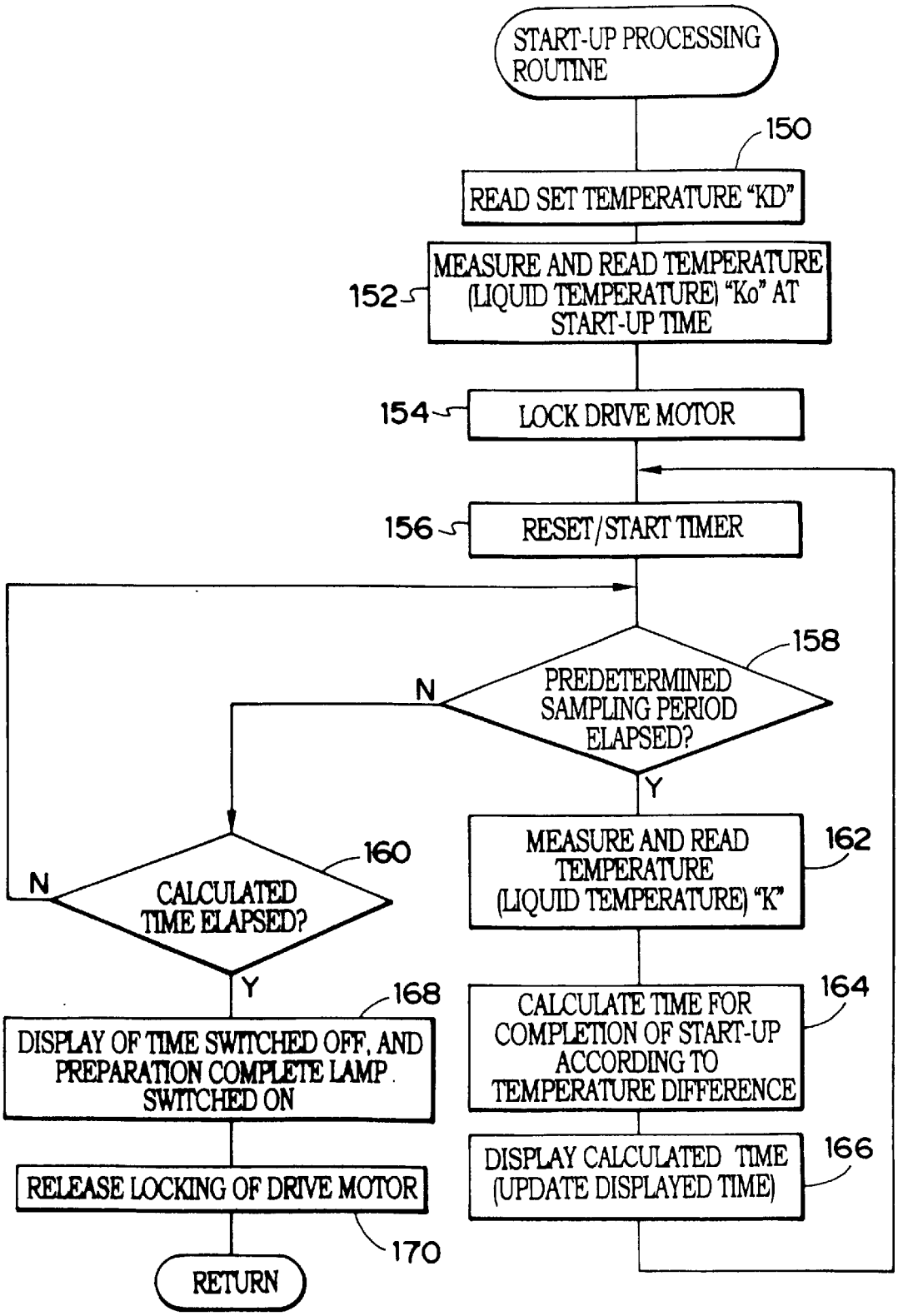
FIG. 4 is a flow chart showing an example of start-up processing of an automatic developing apparatus according to a first embodiment of the present invention.

FIG. 4 is a flow chart which shows an example of the start-up processing of the automatic developing apparatus 10, and the start-up processing will be hereinafter described with reference to the flow chart.

The flow chart shown in FIG. 4 is executed by the operating switch 112 being turned on. In the first step 150, respective set temperatures KD of the developing solution, the fixing solution, and the interior of the drying section 50 (i.e., dry air and the heating rollers 60), which are previously stored in a memory (ROM 70 or RAM 72), are read.

Meanwhile, a plurality of processing modes are previously set in the automatic developing apparatus 10 and data based on these processing modes are set and stored in the memory. When the operating switch 112 is in an on-state, the processing mode can be altered by operating the mode switch 120. The alteration of the processing mode can be made even when the automatic developing apparatus 10 is in an operating state. Further, when the automatic developing apparatus 10 reads the set temperature predetermined in accordance with each processing mode, the heaters 86A, 86B, the halogen lamps 92A, 92B, and the heater 96 are operated so that the developing solution, the fixing solution and the interior of the drying section 50 are heated to reach each set temperature KD, and are subjected to on/off control processing in accordance with the detected results of the liquid temperature sensors 82A, 82B, the temperature sensors 88A, 88B, and the temperature sensor 90, so that the developing solution, the fixing solution and the interior of the drying section 50 are each maintained at the set temperatures KD.

Figure 5:
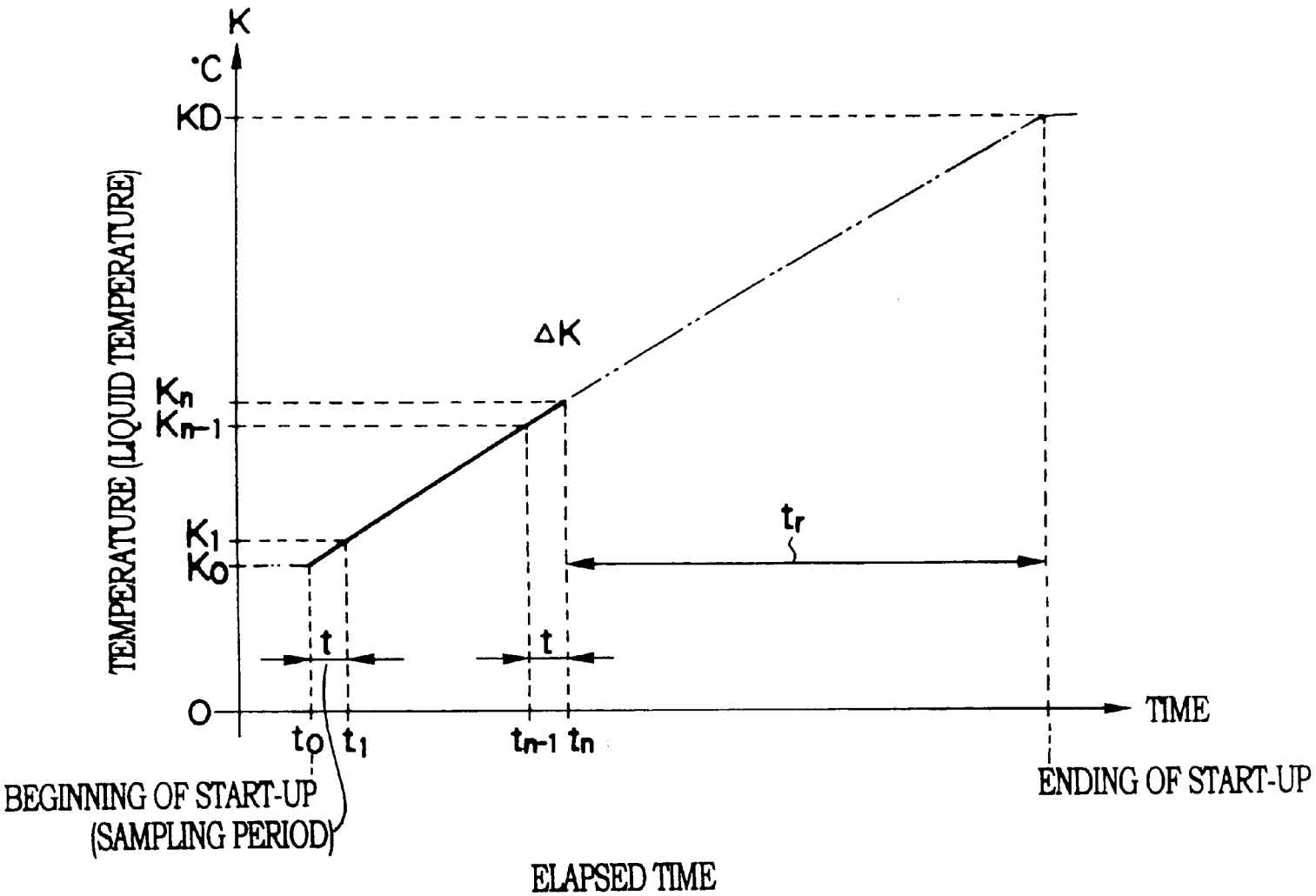
FIG. 5 is a graph which schematically shows a change in the temperature of a developing solution with the lapse of time.

Next, referring now to FIG. 5, the start-up processing will be described in a case of the developing solution and note that start-up processing similar to the above will be effected for the fixing solution and the drying section 50 as well. Namely, when the start-up processing of the drying section is effected, steps 150, 152, 162, and the like in the flow chart of FIG. 4 may be executed for, in place of the temperature of the developing solution, the temperature of a previously-designated predetermined position within the drying section, for example, the temperature of the heating rollers detected by the sensors 88A, 88B, or the temperature of dry air detected by the sensor 90.

In the flow chart shown in FIG. 4 executed for the developing solution, step 152 effects reading of a temperature $K_0$ of the developing solution at the beginning of the start-up processing by the liquid temperature sensor 82A. At the same time, in step 154, operation of the drive motor 80 in accordance with the detected results of the insertion detecting sensor 78 is prohibited (i.e., the drive motor 80 is locked). Meanwhile, intermittent operation of the drive motor 80 resulting from start-up of the automatic developing apparatus 10 is allowed only when insertion of the film 20 is not detected.

The subsequent step 156 resets/starts a timer. Thereafter, in step 158, it is checked whether a predetermined sampling period t has elapsed according to the timer measurement.

When it is judged that the predetermined sampling period t has elapsed (when the decision of step 158 is yes), the routine proceeds to step 162, in which the temperature K of the developing solution is measured by the liquid temperature sensor 82A, and the measured temperature K of the developing solution is read. Next, step 164 calculates a time $t_r$ for completing the start-up processing of the automatic developing apparatus 10, which is a time required for the developing solution to reach the set temperature KD.

On the other hand, when the predetermined sampling period t has not elapsed yet according to the timer measurement in step 158 (when the decision of step 158 is no), the routine proceeds to step 160, and when the time $t_r$ for completing the start-up processing has not elapsed (when the decision of step 160 is no), the routine returns to step 158.

Namely, as shown in the following formulae, the rate of change ΔK of the temperature of the developing solution with respect to an elapsed time can be calculated from the temperature difference between a currently-sampled developing solution temperature $k_n$ and a precedingly-sampled developing solution temperature $K_{(n-l)}$, and from the sampling period t (i.e., the temperature difference between a currently-sampled time $t_n$ and a precedingly-sampled time $t_{(n-l)}$, and see formula (1) below).

$$\Delta K = \frac{K_n - K_{(n-1)}}{n} \tag{1}$$

$$Tr = \frac{(KD - Kn)}{\Delta K} \tag{2}$$

Next, the time required for the temperature of the developing solution to reach the set temperature KD can be calculated from the rate of change ΔK of the temperature of the developing solution and from the temperature difference between the set temperature KD and the currently-measured temperature Kn (see formula (2) above). The time Tr becomes a remaining time $t_r$ for completing the start-up of the automatic developing apparatus 10.

When the start-up of the automatic developing apparatus 10 begins, the heater 86A starts heating the developing solution and the circulation pump 84A is also operated to uniformly agitate the developing solution within the developing tank 14. For this reason, as shown in FIG. 5, the temperature of the developing solution rises substantially in a linear manner. The linear gradient of an increase in the temperature of the developing solution becomes the rate of change ΔK of the temperature of the developing solution. Accordingly, in order to calculate a time required for completing the start-up processing at a first point in which a time period t has elapsed after beginning of the start-up processing of the automatic developing apparatus 10, what should be done is only to calculate the rate of change ΔK of the temperature of the developing solution from the preceding temperature $K_0$ and the currently-measured temperature $K_1$.

Subsequently, in step 166, the calculated time Tr is displayed on the LCD 104 of the display device 100 as a remaining time $t_r$ for completing the start-up of the automatic developing apparatus 10 and starting processing of the film 20. As the remaining time $t_r$ displayed on the LCD 104, a required time for completing the start-up may be constantly displayed while the remaining time is being counted down in accordance with the lapse of time. Alternatively, the remaining time $t_r$ to be displayed each time the sampling period t elapsed may be changed so that it practically looks as if the remaining time $t_r$ is being counted down.

As a result, in the automatic developing apparatus 10, when the operating switch 112 is turned on, the required time for completing the start-up processing, i.e., the timing at which processing of the film 20 can start is displayed on the display device 100 in real time. Further, steps 156, 158, 162, 164, and 166 are executed repeatedly, and therefore, the remaining time $t_r$ to be displayed on the LCD 104 of the display device 100 is updated for each sampling period t and the correct remaining time is constantly displayed on the LCD 104.

On the other hand, in step 160, it is checked whether or not the calculated time has elapsed. When the calculated time has elapsed (the remaining time $t_r$ displayed on the LCD 104 has become "0"), the decision of step 160 is affirmative and the routine proceeds to step 168. In step 168, display of the remaining time $t_r$ for completing the start-up, which is displayed on the LCD 104 of the display device 100, is switched off, so that the preparation complete lamp 108 is switched on, and the completion of the start-up processing is indicated. At the same time, step 170 effects lock releasing processing for the drive motor 80.

As a result, the automatic developing apparatus 10 allows operation of the drive motor 80 in accordance with the detection results of the insertion detecting sensor 78 and when the film 20 is inserted from the insertion opening 15, conveying of the film 20 starts.

When start-up of the automatic developing apparatus 10 is effected by operating the operating switch 112, the time required for completing the start-up is displayed on the LCD 104 of the display device 100, and therefore, it is possible to precisely predict the timing at which the film 20 can be processed by the automatic developing apparatus 10 and it is also possible to set up a standard of the time at which processing of the film 20 can start in the automatic developing apparatus 10. As a result, for example, not only it is not necessary for an operator to wait in the vicinity of the automatic developing apparatus 10 until the start-up processing is completed (i.e., all during the start-up processing), but also it is possible for the operator to effect other operations during the start-up processing of the automatic developing apparatus 10, thereby improving the operating efficiency.

Further, in the automatic developing apparatus 10, until the start-up processing is completed and the film 20 thus can be finished at an appropriate quality, even when the film 20 is inserted from the insertion opening 15, operation of the drive motor 80 is not allowed. For this reason, there is no possibility that the film 20 mistakenly inserted in the apparatus during the start-up processing is processed which leads to deterioration of a finished quality of the film 20.

As mentioned above, the present embodiment is described such that the time $t_r$ required for the temperature of the developing solution to reach the set temperature KD is calculated on the basis of a change in the temperature of the developing solution, and the calculated time Tr is displayed on the LCD 104 of the display device 100 as the remaining time $t_r$ for completing the start-up of the automatic developing apparatus 10. However, respective times Tr required for the temperature of the developing solution and the fixing solution, or for the temperature of the developing solution, the fixing solution and the drying section 50 to reach the set temperature are calculated, the longest time among these calculation results may be displayed as the remaining time $t_r$ for completing the start-up of the automatic developing apparatus 10.

Further, it can be arranged such that when the remaining time $t_r$ displayed on the LCD 104 of the display device 100 is counted down in accordance with the lapse of time, the timing at which the remaining time $t_r$ becomes "0" is judged as the completion of the start-up processing of the automatic developing apparatus 10.

Meanwhile, in the present embodiment, the remaining time $t_r$ for completing the start-up processing of the automatic developing apparatus 10 from the beginning of the start-up processing, which is displayed for the first time on the LCD 104 of the display device 100, is calculated on the basis of the set temperature KD, the temperature $K_0$ at the beginning of the start-up processing, and an initially-sampled temperature $K_1$. However, the present invention is not limited to the same.

For example, the quantity of the developing solution contained in the developing tank 14 of the automatic developing apparatus 10 and the capacity of the heater 86A have already been made known, and therefore, by setting an approximate rate of change of the temperature of the developing solution on the basis of the aforementioned, when the start-up processing of the automatic developing apparatus 10 begins, the remaining time $t_r$ for completing the start-up can be displayed only by reading the set temperature KD and the temperature $K_0$ of the developing solution at the beginning of the start-up processing immediately after the operating switch 112 is turned on.

Further, it can be further arranged such that each time the start-up processing is completed, the temperature $K_0$ at the beginning of the start-up for each set temperature KD and the time actually required for the start-up processing are stored, a LUT (look-up table) is prepared for each set temperature, and when the subsequent start-up processing is effected, the start-up time Tr is set from the LUT. As a result, the precise start-up time Tr can be easily calculated.

[Second Embodiment]

Next, a second embodiment of the present invention will be described. It should be noted that the basic structure of the second embodiment is that of the first embodiment, and the same members as those of the first embodiment will be denoted by the same reference numerals, and a description thereof will be omitted.

A plurality of processing modes are set in the automatic developing apparatus 10, and respective temperatures of the developing solution, the fixing solution, and the drying section 50 are set for each of the processing modes. For this reason, by operating the mode switch 120 of the display device 100 to alter the processing mode, the set temperature KD is altered.

FIG. 6 shows start-up processing accompanied with a change of mode. Meanwhile, in the second embodiment, a description will be given of the case of the developing solution in the same manner as in the first embodiment, and descriptions of other elements within the automatic developing apparatus 10, for example, the fixing solution and the drying section 50, will be omitted.

The flow chart is executed when the mode changing processing is effected. In the first step 180, it is checked whether the set temperature has been changed, and when the set temperature KD is changed (when the decision of step 180 is yes), the routine proceeds to step 182, in which the set temperature KD corresponding to the set processing mode is read. Next, in step 184, the temperature of the existing developing solution is measured and the measured temperature is read as the temperature $K_0$. Meanwhile, within the automatic developing apparatus 10, the heaters 86A, 86B, the halogen lamp 92 and the heater 96 are controlled in accordance with the set temperature KD corresponding to the processing mode.

Subsequently, in the same way as in the flow chart shown in FIG. 4 in the above-described first embodiment, after locking of the drive motor 80, the start-up processing corresponding to the change of the processing mode may be effected by measuring the temperature K of the developing solution for each predetermined sampling period t. At this time, even when the set temperature KD is to be lowered, for example, from 36° C. to 35° C., the similar processing can be effected. Namely, when the set temperature KD is lowered, only the gradient of a change in the temperature (i.e., the liquid temperature) merely exhibits different state. So long as the rate of change ΔK corresponding to a decrease in the temperature K may be obtained, the remaining time $t_r$ for completing the change of the mode can be appropriately displayed on the LCD 104 of the display device 100.

As described above, even when the set temperature KD is changed in accordance with alteration of the processing mode, the remaining time for reaching the timing at which the film 20 can be processed in the newly-set processing mode is displayed on the display device 100 and this can be made as a proper standard for starting processing of the film 20 in the new processing mode. Further, even when the processing mode is altered, the drive motor 80 is locked until the start-up processing for the altered processing mode is completed, and therefore, there is no possibility that the film 20 is processed in the course of alteration of the processing mode. Accordingly, it is possible to prevent occurrence of such a problem as that the film 20 is processed in the course of alteration of the processing mode so that a desired finished quality cannot be obtained.

Meanwhile, in the above-described embodiments, the case of the automatic developing apparatus 10 which processes, as the photosensitive material, an X-ray film (film 20) which is a kind of photographic film was described as an example, but the present invention is not limited to the same. For example, the present invention may be applied to automatic developing apparatuses for processing various photosensitive materials such as elongated photographic films, photographic printing papers and the like, and also may be applied to automatic developing apparatuses for processing photosensitive planographic plates each of which is a printing photosensitive material with a photosensitive layer formed on a surface of a resin or metal plate, an interior of the automatic developing apparatus being heated to a predetermined temperature.

As described above, according to the present invention, when the start-up processing for setting the interior of the apparatus to a predetermined temperature begins, the required time for completing of the start-up processing is predicted by the display means, and therefore, when the time is displayed, the time from start-up of the apparatus to the timing at which processing of the photographic photosensitive material can start can be effectively utilized. Further, in the present invention, since operation of introduction means for introducing the photosensitive material in the automatic developing apparatus on the basis of the predicted time is prohibited. For this reason, even when the photographic photosensitive material is mistakenly inserted during the start-up processing, there is no possibility that the inserted photographic photosensitive material is processed so that the finished quality thereof is damaged. Further, even when the time which allows processing of the film is indicated by a lamp, the predicted time can be utilized.

What is claimed is:

1. An automatic developing apparatus, which is used to process a photosensitive material, comprises:

a developing tank;

a fixing tank;

a washing tank;

temperature detecting means which detects a temperature of a processing solution in any one of the three tanks;

temperature setting means which sets a target temperature of the processing solution;

temperature adjusting means which adjusts the temperature of the processing solution;

temperature controlling means which controls said temperature adjusting means so that the temperature of the processing solution is adjusted from a temperature detected by said temperature detecting means to the target temperature;

time calculating means for calculating a time for said temperature adjusting means to adjust the temperature of the processing solution from the detected temperature to the target temperature; and selective blocking means for preventing advance of photosensitive material through the developing apparatus during the time of adjusting the temperature of the processing solution from the detected temperature to the target temperature, and allowing advance of photosensitive material through the developing apparatus when the calculated time has elapsed.

2. An automatic developing apparatus according to claim 1, further comprising:

introducing means which introduces the photosensitive material into said automatic developing apparatus; and drive controlling means which controls operation of said introducing means, said drive controlling means including introduction-of-photosensitive material prohibiting means which prohibits operation of said introducing means from a timing at which the temperature of the processing solution is detected by said temperature detecting means until a timing at which the time calculated by said time calculating means has elapsed.

3. An automatic developing apparatus according to claim 1, further comprising:

display means which indicates the time calculated by said time calculating means.

4. An automatic developing apparatus according to claim 3, wherein the displayed calculated time sequentially decreases until the temperature of the processing solution reaches the set temperature.

5. An automatic developing apparatus according to claim 1, further comprising:

completion-of-processing-preparation displaying means which indicates that processing preparation of said automatic developing apparatus is completed after the time calculated by said time calculating means starting from the time of detection of the temperature by said temperature detecting means elapsed.

6. An automatic developing apparatus according to claim 1, further comprising:

a photosensitive material detecting means which detects a photosensitive material at a predetermined position in said automatic developing apparatus, wherein said selective blocking means allows advance of the photosensitive material through the developing apparatus in accordance with results of detection by said photosensitive material detecting means.

7. An automatic developing apparatus according to claim 1, wherein said selective blocking means begins advancing of the photosensitive material through the developing apparatus when the calculated time has elapsed.

8. An automatic developing apparatus according to claim 1, wherein each time a predetermined period of time elapses, said time calculating means calculates a time of adjusting the temperature of the processing solution to the target temperature so that the time of adjusting the temperature of the processing solution to the target temperature can always be updated to a correct value.

9. An automatic developing apparatus, which is used to process a photosensitive material, comprising:

a developing tank;

a fixing tank;

a washing tank;

a drying section for drying photosensitive material conveyed from the washing tank;

temperature detecting means which detects a temperature of a portion of the drying section;

temperature setting means for setting a target temperature of the portion of the drying section;

temperature adjusting means for adjusting the temperature of the portion of the drying section;

temperature controlling means for controlling said temperature adjusting means so that the temperature of the portion of the drying section is adjusted from a temperature detected by said temperature detecting means to the target temperature;

time calculating means for calculating a time for said temperature adjusting means to adjust the portion of the drying section from the detected temperature to the target temperature; and selective blocking means for preventing advance of photosensitive material through the developing apparatus during the time of adjusting the temperature of the portion of the drying section from the detected temperature to the target temperature, and allowing advance of photosensitive material through the developing apparatus when the calculated time has elapsed.

10. An automatic developing apparatus according to claim 9, further comprising:

display means which indicates the time calculated by said time calculating means.

11. An automatic developing apparatus according to claim 10, wherein the displayed calculated time sequentially decreases until the temperature of the processing solution reaches the set temperature.

12. An automatic developing apparatus according to claim 9, further comprising:

completion-of-processing-preparation displaying means which indicates that processing preparation of said automatic developing apparatus is completed after the time calculated by said time calculating means starting from the time of detection of the temperature by said temperature detecting means elapsed.

13. An automatic developing apparatus according to claim 9, wherein said temperature detecting means is means for detecting a temperature of a heating roller and said temperature adjusting means is a halogen lamp that heats up the heating roller.

14. An automatic developing apparatus according to claim 9, wherein said temperature detecting means is means for detecting a temperature of dry air and said temperature adjusting means is a heating roller that heats up the dry air.

15. An automatic developing apparatus according to claim 9, further comprising:

a photosensitive material detecting means which detects the photosensitive material at a predetermined position in said automatic developing apparatus, wherein said selective blocking means allows advance of the photosensitive material through the developing apparatus in accordance with results of detection by said photosensitive material detecting means.

16. An automatic developing apparatus according to claim 9, wherein said selective blocking means begins advancing of the photosensitive material through the developing apparatus when the calculated time has elapsed.

17. An automatic developing apparatus according to claim 9, wherein each time a predetermined period of time elapses, said time calculating means calculates a time of adjusting the temperature of the portion of the drying section to the target temperature so that the time of adjusting the temperature of the portion of the drying section to the target temperature can always be updated to a correct value.

18. An automatic developing apparatus, which is used to process a photosensitive material, comprising:

a developing tank;

a fixing tank;

a washing tank;

a drying section in which dry air is blown against a surface of photosensitive material conveyed from the washing tank;

first temperature detecting means which detects a temperature of a processing solution in any one of the processing tanks;

first temperature setting means which sets a first target temperature of the processing solution;

first temperature adjusting means which adjusts the temperature of the processing solution;

first temperature controlling means which controls said first temperature adjusting means so that the temperature of the processing solution is adjusted from the temperature detected by said first temperature detecting means to the first target temperature;

first time calculating means which calculates a time for said first temperature adjusting means to adjust the processing solution from the detected temperature to the first target temperature;

second temperature detecting means which detects a temperature of a portion of the drying section;

second temperature setting means which sets a second target temperature of the portion of the drying section;

second temperature adjusting means which adjusts the temperature of the portion of the drying device;

second temperature controlling means which controls said second temperature adjusting means so that the temperature of the portion of the drying section is adjusted from a temperature detected by said second temperature detecting means to the second target temperature;

second time calculating means which calculates a time for said second temperature adjusting means to adjust the temperature of the portion of the drying section from the detected temperature to the second target temperature;

completion-of-processing-preparation displaying means which indicates that processing preparation of said automatic developing apparatus is completed after the longer one of the periods of time respectively calculated by said first and second time calculating means has elapsed; and selective blocking means which prevents advance of photosensitive material through the developing apparatus during the time of adjusting the temperature of the portion of the drying section and the temperature of the processing solution, and allows advance of photosensitive material through the developing apparatus when the longer one of the periods of time respectively calculated by said first and second time calculating means has elapsed.

19. An automatic developing method in an automatic developing apparatus which is used to process a photosensitive material and which includes three processing tanks formed from a developing tank, a fixing tank, and a washing tank and further includes controlling means for controlling to start up a temperature of a processing solution in any one of the processing tanks to an optimum temperature for development processing, said method comprising the steps of:

reading a set temperature of the processing solution by said controlling means;

detecting an initial temperature of the processing solution;

stopping a drive motor for driving a conveying roller of the photosensitive material;

detecting the temperature of the processing solution at a predetermined sampling timing;

calculating and indicating a time for completing the start-up processing from a temperature difference between the detected temperature of the processing solution and the initial temperature;

detecting the temperature of the processing solution at a subsequent sampling timing;

calculating a completion time of the start-up from a time difference between the detected temperature of the processing solution and a previously detected temperature of the processing solution, and updating and displaying the indicated completion time of the start-up;

effecting the above updating processing repeatedly until the indicated completion time of the start-up elapses;

displaying that start-up preparation is completed when the completion time of the start-up has elapsed; and releasing stoppage of the drive motor so as to allow advance of photosensitive material through the developing apparatus.

20. An automatic developing apparatus, which is used to process a photosensitive material, comprises:

a developing tank;

a fixing tank;

a washing tank;

temperature detecting means which detects a temperature of a processing solution in any one of the three tanks;

temperature setting means which sets a target temperature of the processing solution;

temperature adjusting means which adjusts the temperature of the processing solution;

temperature controlling means which controls said temperature adjusting means so that the temperature of the processing solution is adjusted from a temperature detected by said temperature detecting means to the target temperature;

time calculating means for calculating a time for said temperature adjusting means to adjust the temperature of the processing solution from the detected temperature to the target temperature; and selective blocking means for preventing advance of photosensitive material through the developing apparatus during the time of adjusting the temperature of the processing solution from the detected temperature to the target temperature, and allowing advance of photosensitive material through the developing apparatus when the calculated time has elapsed;

wherein each time a predetermined period of time elapses, said time calculating means calculates a time of adjusting the temperature of the processing solution to the target temperature so that the time of adjusting the temperature of the processing solution to the target temperature can always be updated to a correct value.

* * * * *